US006745595B1

(12) United States Patent
Kateman et al.

(10) Patent No.: US 6,745,595 B1
(45) Date of Patent: Jun. 8, 2004

(54) NON-STICK FREEZING SURFACE

(75) Inventors: Paul R. Kateman, Wellesley, MA (US); Charles S. Brunner, N. Reading, MA (US)

(73) Assignee: Moobella, LLC, Taunton, MA (US)

( * ) Notice: Subject to any disclaimer, the term of this patent is extended or adjusted under 35 U.S.C. 154(b) by 0 days.

(21) Appl. No.: 10/431,777

(22) Filed: May 7, 2003

Related U.S. Application Data

(60) Provisional application No. 60/455,707, filed on Mar. 18, 2003.

(51) Int. Cl.[7] ..... F25D 13/00

(52) U.S. Cl. ..... 62/458; 165/168

(58) Field of Search ..... 62/353, 354, 458; 165/115, 168

(56) References Cited

U.S. PATENT DOCUMENTS 5,438,839 A * 8/1995 Wardle ..... 62/63
5,918,477 A * 7/1999 Gall et al. ..... 62/354

* cited by examiner

*Primary Examiner*—Melvin Jones
(74) *Attorney, Agent, or Firm*—Cesari and McKenna, LLP

(57) ABSTRACT

A non-stick freezing surface for freezing a thin layer of liquid food product includes a thermally conductive platen having a smooth upper surface and a coating containing PTFE covering that surface. Preferably, the coating is of nickel-infused PTFE.

6 Claims, 1 Drawing Sheet

NON-STICK FREEZING SURFACE

RELATED APPLICATION

This application claims the benefit of provisional application No. 60/455,707, filed Mar. 18, 2003.

BACKGROUND OF THE INVENTION

This invention relates to apparatus for producing and dispensing frozen confections by depositing a liquid mix onto a freezing surface as a thin layer and then scraping the resulting frozen product from that surface into a container. It relates especially to an improved non-stick freezing surface for such apparatus.

1. Field of the Invention

Frozen food products such as ice cream and frozen yogurt are now being produced by depositing a flavored liquid mix onto a freezing surface so that the liquid mix spreads out on that surface as a thin layer which is immediately frozen or partially frozen. The product layer is then scraped from the freezing surface into a container, or more preferably, into a compaction device which compacts the frozen scrapings into a solid body or "scoop" which is thereupon deposited into a container such as a cup or cone. An example of an apparatus for producing a frozen food product in this fashion manually is described in U.S. Pat. No. 5,473,909 and related patents. Apparatus for producing and dispensing such products automatically using a rotating freezing surface is described in application Ser. No. 10/160,674, filed Jul. 31, 2002, the contents of which is hereby incorporated herein by reference. It should be understood, however, that the invention has application to other surfaces which may come into contact with frozen ice cream, yogurt and the like products, e.g. continuous or batch freezers.

2. Description of the Prior Art

Conventionally, the freezing surfaces with which we are concerned have consisted of the finished surfaces of thermally conductive platens or tables through which a refrigerant is circulated in order to cool the freezing surfaces to a low temperature, e.g. −15° F. to +5° F. In prior apparatus of this general type, it has been the practice to provide the platen with a mirror smooth surface which is devoid of any coating. This is because in the frozen food industry it has been the prevailing view that such coatings provide sites for bacterial growth when contacted by a food product for an appreciable period of time. In fact, the National Sterilization Foundation (NSF) has promulgated rules prohibiting the use of non-stick or other coatings on freezing surfaces contacted by ice cream and other frozen confections. Resultantly, product tends to adhere to freezing surfaces of the type described in the above patent/application. This can be troublesome when dispensing ice cream or frozen yogurt having different flavors because of product carry over from one serving to the next.

It would be desirable, therefore, if the apparatus described in the above-identified patent/application could be provided with a non-stick freezing surface in order to facilitate complete removal of the frozen product from the freezing surface between servings.

SUMMARY OF THE INVENTION

Accordingly, it is an object of the present invention to provide an improved freezing surface for apparatus that produces and dispenses frozen confections.

Another object of the invention is to provide a platen or table having a non-stick freezing surface for easy wear of the confection.

Yet another object of the invention is to provide a non-stick surface for quickly freezing a liquid product mix deposited as a relatively thin layer on that surface.

Other objects will, in part, be obvious and will, in part, appear hereinafter.

This invention accordingly comprises the features of construction, combination of elements and arrangement of parts which will be exemplified in the following detailed description, and the scope of the invention will be indicated in the claims.

Briefly, the non-stick freezing surface herein is constituted by the upper surface of a thermally-conductive platen. The surface has a smooth finish and is coated with and organic metal polytetraflouroethylene (PTFE) material.

The freezing surface retains its non-stick characteristic when cycled repeatedly between temperatures in the range of −15° F. and room temperature (70° F.) over a prolonged period.

BRIEF DESCRIPTION OF THE DRAWING

For a fuller understanding of the nature and objects of the invention, reference should be made to the following detailed description taken in connection with the accompanying drawing, in which.

DETAILED DESCRIPTION OF AN ILLUSTRATIVE EMBODIMENT

Figure 1:
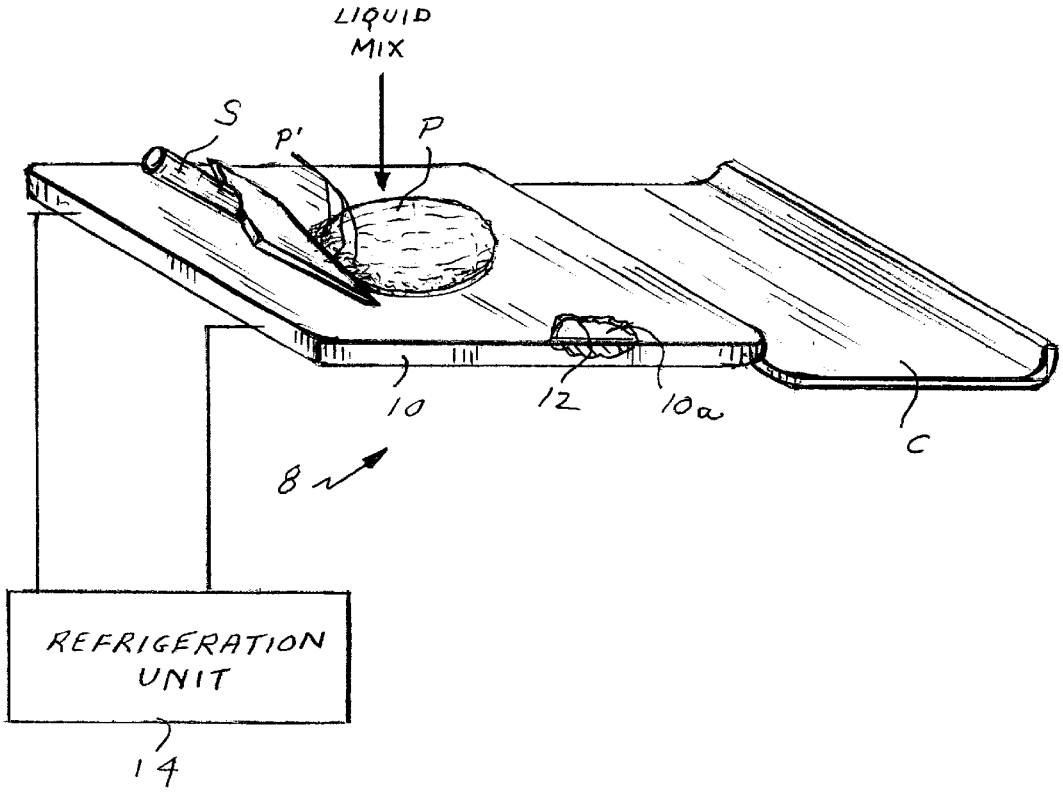
FIG. 1 is a perspective view of a non-stick freezing surface incorporating the invention.

Referring to the drawing figure, the non-stick surface shown generally at 8 is formed by a platen or table 10 having an upper surface 10*a* which is polished smooth, e.g. a surface finish of 24RA or better. The surface 10*a* is covered by a coating 12 of metal-infused PTFE. More specifically, coating 12 is a combined nickel PTFE material preferably of the type marketed by Endura, Co., 2029 Riggs, Warren Mich. 48091, under the trademark ENDURA.

Preferably, coating 12 has a thickness in the range of 0.001 to 0.002 in. and is applied evenly over the platen surface 10*a* so that the top of the freezing surface 8 is perfectly flat.

The illustrated freezing surface 8 is a stationary surface of the type disclosed in the above patent. However, the surface could just as well be a rotary surface of the type described in the above application or any other surface common associated with the process ice cream or yogurt. As described there, platen 10 is connected in a refrigeration loop with a refrigeration unit 14. A liquid refrigerant may be circulated through the platen 10 so that when a liquid product mix is deposited on the freezing surface 8, it spreads out into a thin layer and quickly freezes or partially freezes to form a frozen product P. When frozen, the product P may be scraped from the freezing surface as scrapings P' by a scraper S and the scrapings deposited in a container C such as a cup, compactor, etc. The scraper S may a hand held scraper when the freezing surface is a stationary one as described in the above patent. Alternatively, the scraper S may be a stationary blade which scrapes a rotating freezing surface as described in the above pending application. In both cases, the coating 12 releases the frozen product P so that it can be removed from the freezing surface and deposited in the container C in its entirety. In other words, there is minimum residue left on the freezing surface which could be entrained in a subsequent deposit of liquid product mix on the surface 8.

It should be emphasized that while PTFE coatings have been used in other applications such as on frying pans and the like intended for high temperature applications, to applicant's knowledge, such coatings have not been applied to surfaces intended to come into contact with food products in the process of being frozen because of the potential for bacterial growth on such coated surfaces as described at the outset. Applicant's freezing surface is unique in that it has obtained the approval of the NSF for use in the production and dispensing of frozen food products, specifically frozen confections, in the manner described in the above patent/application.

It will thus be seen that the objects set forth above among those made apparent from the preceding description are efficiently attained, and since certain changes may be made in the above construction without departing from the scope of the invention, it is intended that all matter contained in the above description or shown on the accompanying drawing shall be interpreted as illustrative and not in the limiting sense.

It is also to be understood that the following claims are intended to cover all of the generic and specific features of the invention described herein.

What is claimed is:

1. A non-stick freezing surface which readily releases food products at low temperatures, said surface comprising a thermally conductive platen having a smooth upper surface;

an organic coating on said surface, and means for cooling said platen.

2. The freezing surface defined in claim 1 wherein the coating comprises PTFE.

3. The freezing surface defined in claim 2 wherein said upper surface has a surface finish of 24RA or better.

4. The freezing surface defined in claim 2 wherein said coating is of a combined metal PTFE material.

5. The freezing surface defined in claim 4 wherein said coating is of nickel-infused PTFE.

6. The freezing surface defined in claim 5 wherein said coating has a thickness in the range of 0.001 to 0.002 in.

* * * * *